US007299896B1

(12) United States Patent
Adifon et al.

(10) Patent No.: US 7,299,896 B1
(45) Date of Patent: Nov. 27, 2007

(54) ELEVATOR SYSTEM HAVING DRIVE MOTOR LOCATED ADJACENT TO HOISTWAY DOOR

(75) Inventors: Leandre Adifon, Farmington, CT (US); Richard J. Ericson, Southington, CT (US); David Wayne Jones, Mentone (AU); Armando Servia, Madrid (ES); Jose Sevilleja, Madrid (ES)

(73) Assignee: Otis Elevator Company, Farmington, CT (US)

( * ) Notice: Subject to any disclaimer, the term of this patent is extended or adjusted under 35 U.S.C. 154(b) by 1416 days.

(21) Appl. No.: 09/163,207

(22) Filed: Sep. 29, 1998

(51) Int. Cl.
*B66B 11/08* (2006.01)

(52) U.S. Cl. ..... 187/254; 187/414

(58) Field of Classification Search ..... 187/239, 187/251, 254, 266, 414; 310/258
See application file for complete search history.

(56) References Cited

U.S. PATENT DOCUMENTS

| | | | | |
|---|---|---|---|---|
| 1,071,309 A | | 8/1913 | Goggin | |
| 3,101,130 A | | 8/1963 | Bianca | |
| 4,280,593 A | * | 7/1981 | Moore | 187/266 |
| 4,570,753 A | | 2/1986 | Ohta et al. | 187/1 |
| 4,664,230 A | | 5/1987 | Olsen | 187/39 |
| 4,949,815 A | | 8/1990 | Pavoz | 187/20 |
| 5,429,211 A | | 7/1995 | Aulanko et al. | 187/254 |
| 5,435,417 A | | 7/1995 | Hakala | 187/404 |
| 5,469,937 A | | 11/1995 | Hakala et al. | 187/266 |
| 5,490,578 A | * | 2/1996 | Aulanko et al. | 187/266 |
| 5,533,595 A | * | 7/1996 | Narumi et al. | 187/266 |
| 5,740,888 A | | 4/1998 | Aulanko et al. | 187/336 |

FOREIGN PATENT DOCUMENTS

| | | | | |
|---|---|---|---|---|
| AU | 1 032 496 | | 6/1958 | |
| DE | 1 000 138 | | 1/1957 | |
| DE | 1032496 | | 6/1958 | |
| DE | 1 033 383 | | 7/1958 | |
| DE | 436 619 | | 11/1967 | |
| DE | 003922798 | * | 9/1990 | 187/266 |
| DE | T-7395 | | 11/1992 | |
| DE | 296 15 921 | U1 | 4/1997 | |
| EP | 000565956 | * | 10/1993 | 187/266 |
| EP | 0 606 875 | A1 | 1/1994 | |
| EP | 0 779 233 | A2 | 6/1994 | |
| EP | 0 784 030 | A2 | 6/1994 | |
| EP | 0 680 920 | | 5/1995 | |
| EP | 0 688 735 | A2 | 6/1995 | |
| EP | 0 710 618 | A2 | 10/1995 | |
| EP | 0 719 724 | | 12/1995 | |
| EP | 0 749 930 | A2 | 6/1996 | |

(Continued)

OTHER PUBLICATIONS

"Elevator Mechanical Design, Principles and Concepts", by Lubomir Janovsky, Ellis Horwood Limited (1987).

(Continued)

*Primary Examiner*—Andrew Joseph Rudy

(57) ABSTRACT

An elevator system includes a hoistway having a plurality of hoistway doors. An elevator car and counterweight are provided in the hoistway. A drive motor is drivingly coupled to the elevator car and counterweight, and is located adjacent to either the top or bottom portion of a hoistway door so as to eliminate the need to provide a machine room above the hoistway ceiling.

3 Claims, 8 Drawing Sheets

FOREIGN PATENT DOCUMENTS

| | | | | |
|---|---|---|---|---|
| EP | 0 749 931 A2 | | 6/1996 | |
| EP | 0 870 722 | | 4/1998 | |
| FR | 2 640 604 | | 12/1988 | |
| GB | 1 401 197 | | 6/1972 | |
| GB | 2 223 471 | | 12/1983 | |
| GB | G 84 34 382.6 | | 4/1985 | |
| GB | 2 138 397 B | | 11/1985 | |
| GB | 2201657 | | 9/1988 | |
| GB | 2 2-1 657 B | | 8/1990 | |
| JP | 58-184480 | | 9/1954 | |
| JP | 4-50297 | | 1/1957 | |
| JP | 353073751 | * | 6/1978 | ..... 187/266 |
| JP | 354013153 | * | 1/1979 | ..... 187/266 |
| JP | 63-178277 | * | 11/1988 | |
| JP | 63-178278 | | 11/1988 | |
| JP | 1-242386 | | 9/1989 | |
| JP | 1-267286 | | 10/1989 | |
| JP | 402086588 | * | 3/1990 | ..... 187/266 |
| JP | 5-70057 | | 3/1993 | |
| JP | 405078054 | * | 3/1993 | ..... 187/251 |
| JP | 405319744 | * | 12/1993 | ..... 187/266 |
| WO | PCT/FI95/00530 | | 4/1996 | |
| WO | WO96/09978 | | 4/1996 | |
| WO | PCT/FI97/00823 | | 7/1998 | |
| WO | PCT/FI97/00824 | | 7/1998 | |
| WO | PCT/FI98/00205 | | 9/1998 | |
| WO | PCT/FI98/00207 | | 9/1998 | |
| WO | PCT/EP98/02549 | | 11/1998 | |

OTHER PUBLICATIONS

"Hannover Fair: Another new idea from ContiTech—Lifting belts for elevators", ContiTech initiav Jan. 1998 (Hannover Fair '98).

"Der Fahrstuhl", by Die, Geschichte, der vertikalen Eroberung, 9 Siemens, Anm. 2, S. 373 (1984).

* cited by examiner

ELEVATOR SYSTEM HAVING DRIVE MOTOR LOCATED ADJACENT TO HOISTWAY DOOR

FIELD OF THE INVENTION

The present invention relates generally to an elevator system, and more particularly to an elevator system including a drive motor provided adjacent to a hoistway door.

BACKGROUND OF THE INVENTION

Considerable expense is involved in the construction of a machine room for an elevator. The expense includes the cost of constructing the machine room, the structure required to support the weight of the machine room and elevator equipment, and the cost of shading adjacent properties from sunlight (e.g., sunshine laws in Japan and elsewhere).

Elevator systems have been developed to avoid the expense of a machine room. These elevator systems are difficult to install and maintain because hoistway access can be difficult or dangerous especially to maintenance people while working in the hoistway on machinery that controls elevator motion.

It is an object of the present invention to provide an elevator system without a machine room which avoids the above-mentioned drawbacks associated with prior elevator systems.

SUMMARY OF THE INVENTION

An elevator system includes a hoistway having a plurality of hoistway doors. An elevator car and counterweight are provided in the hoistway. A drive motor is drivingly coupled to the elevator car and counterweight, and is located adjacent to one of a top and bottom portion of a hoistway door so as to eliminate the need to provide a machine room close to the hoistway. A control cabinet and a drive motor controller supported on the control cabinet may be provided, wherein the control cabinet is disposed at a side of a hoistway door and slidably movable from a first position within the hoistway to a second position in an adjacent elevator hallway for easy and safe access to the controller.

An advantage of the present invention is that the elevator system significantly reduces the space and construction costs associated with an elevator system having a machine room.

A second advantage of the present invention is simplified and safe access to the drive motor and associated equipment from an elevator hallway or landing.

A third advantage of the present invention is the provision of several alternative drive motor locations for safe and easy access.

DETAILED DESCRIPTION OF THE PREFERRED EMBODIMENTS

Figure 1:
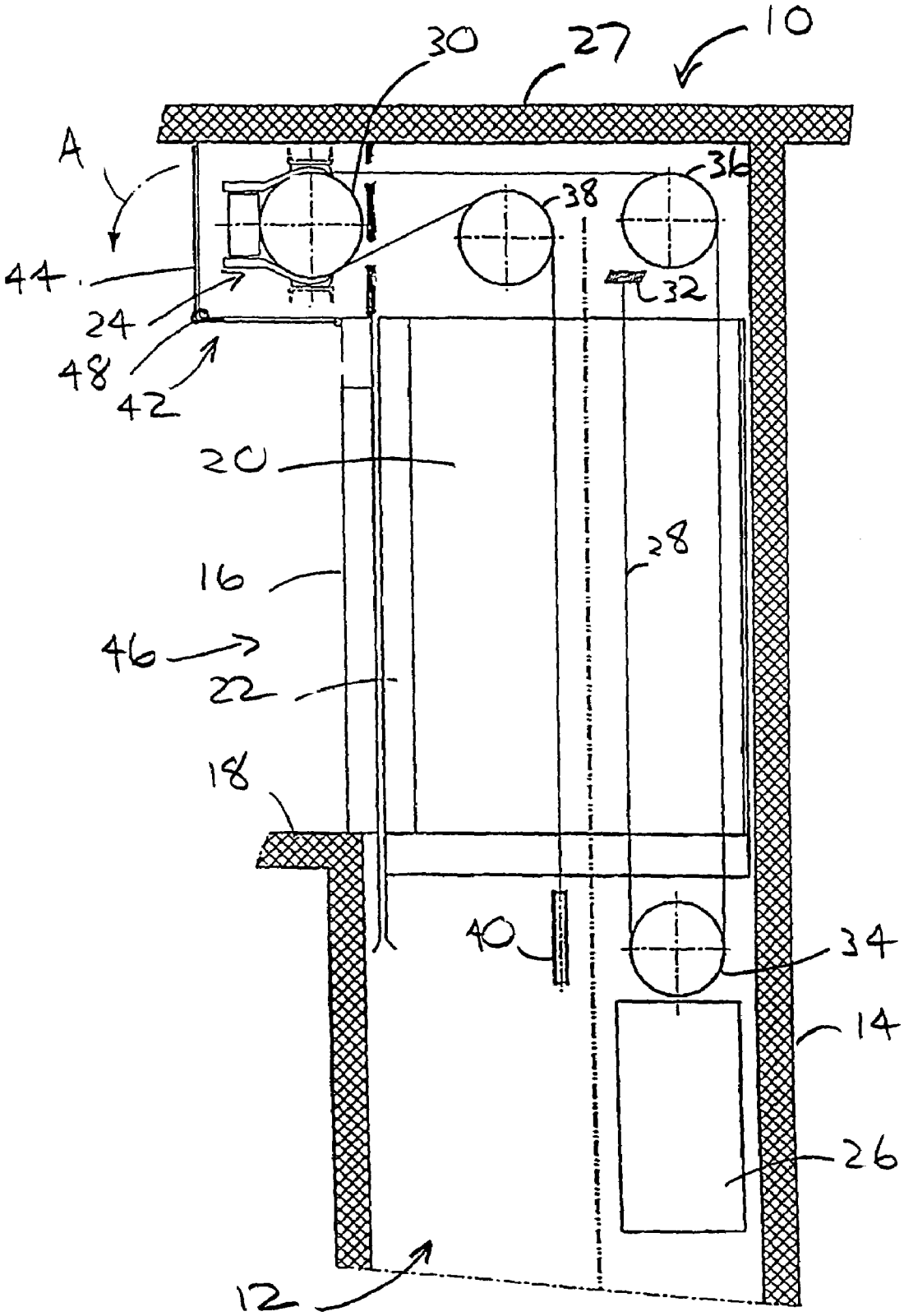
FIG. 1 is a schematic, side elevational view of an elevator system at a top portion of a hoistway having the drive motor accessibly located immediately above a hoistway door.
Figure 2:
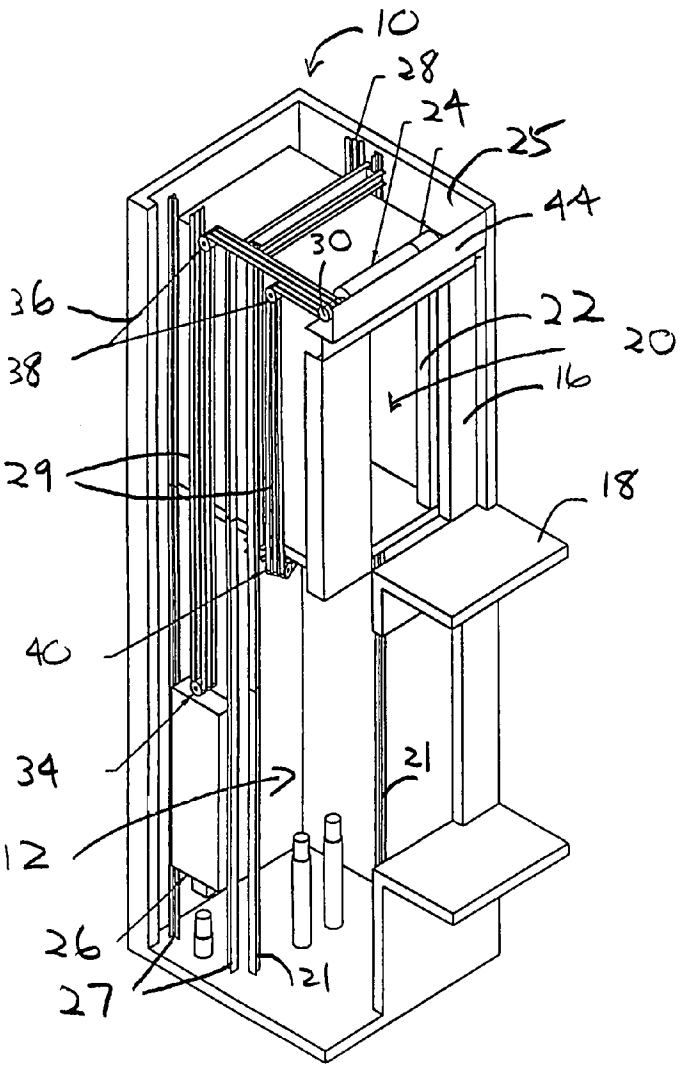
FIG. 2 is a broken away, perspective view of an elevator system employing flexible flat ropes in accordance with the present invention.

FIG. 1 schematically illustrates a side elevational view of an elevator system 10 embodying the present invention which employs round ropes. FIG. 2 is a perspective view of an elevator system 50 which is similar to the elevator system 10 of FIG. 1 except that the elevator system 50 employs flat ropes. Because the elevator systems 10 and 50 are generally similar, both systems will be described together.

The employment of flat ropes or belts permits smaller drive motors and sheaves to drive and suspend elevator car and counterweight loads relative to drive motors and sheaves using conventional round ropes. The diameter of drive sheaves used in elevators with conventional round ropes is limited to 40 times the diameter of the ropes, or larger, due to fatigue of the ropes as they repeatedly conform to the diameter of the sheave and straighten out. Flat ropes or belts have an aspect ratio greater than one, where aspect ratio is defined as the ratio of rope or belt width w to thickness t (Aspect Ratio=w/t). Therefore, flat ropes or belts are inherently thin relative to conventional round ropes. Being thin, there is less bending stress in the fibers when the belt is wrapped around a given diameter sheave. This allows the use of smaller diameter traction sheaves. Torque is proportional to the diameter of the traction sheave. Therefore, the use of a smaller diameter traction sheave reduces motor torque. Motor size (rotor volume) is roughly proportional to torque; therefore, although the mechanical output power remains the same regardless of sheave size, flat ropes or belts allow the use of a smaller drive motor operating at a higher speed relative to systems using conventional round ropes. Consequently, smaller conventional and flat drive motors may be accommodated in the hoistway which significantly reduces the size and construction cost of the hoistway.

In summary, reducing the machine size (i.e., drive motor and sheaves) has a number of advantages. First, a small machine utilizes less material, and will be less costly to produce relative to a larger machine. Second, the light weight of a small machine reduces the time for handling the machine and the need for equipment to lift the machine into place so as to significantly reduce installation cost. Third, low torque and high speed allow the elimination of gears, which are costly. Further, gears can cause vibrations and noise, and require maintenance of lubrication. However, geared machines may also be employed if desired.

Flat ropes or belts also distribute the elevator and counterweight loads over a greater surface area on the sheaves relative to round ropes for reduced specific pressure on the ropes, thus increasing its operating life. Furthermore, the flat ropes or belts may be made from a high traction material such as urethane or rubber jacket with fiber or steel reinforcement.

The elevator systems 10, 50 include a hoistway 12 defined by the surrounding structure 14 (see FIG. 1) of a building. The hoistway 12 includes door openings at each level along the hoistway for accepting hoistway doors. As shown in FIGS. 1 and 2, for example, a hoistway door 16 is provided at an elevator hallway landing 18 at the topmost floor to be serviced by the elevator systems 10, 50. An elevator car 20 is provided in the hoistway 12 for upward and downward movement via elevator guide rails 21, 21 (see FIG. 2) along the hoistway, and includes an elevator door 22 coupled to and for movement along the hoistway with the elevator. As shown in FIGS. 1 and 2, the elevator door 22 is opposed to and aligned with the hoistway door 16 for permitting passenger access to the elevator car 20 at the topmost landing 18.

The elevator systems 10, 50 include a drive motor 24 coupled to a sidewall 25 or an underside of a ceiling 27 (see FIG. 1) of the hoistway 12, and located adjacent to and above the hoistway door 16 for moving the elevator car 20 upwardly and downwardly along the hoistway 12. The drive motor may be geared or gearless in the traction system shown, or alternatively may be a drum motor in a drum drive implementation (not shown). A counterweight 26 movably coupled to counterweight guide rails 27, 27 (see FIG. 2) is provided to one side of the hoistway 12 unoccupied by the elevator 20 for balancing the elevator in its upward and downward movement. At least one elongated connector, such as a round rope 28 as shown in FIG. 1 or at least one flat rope or belt 29 as shown in FIG. 2, rotatably engages a motor sheave 30 of the motor 24 for transmitting rotational movement of the motor sheave 30 to the elevator car 20 and the counterweight 22 in order to move the car and counterweight upwardly and downwardly along the hoistway 12. As shown in FIG. 2, the connector includes three flat ropes 29.

The connector is coupled at a first end to a bracket 32 (see FIG. 1) which is anchored to an upper sidewall or ceiling of the hoistway 12. The connector extends downwardly from its first end at the bracket 32, loops 180° about a counterweight sheave 34 coupled to a top of the counterweight 26, extends upwardly and then loops 90° about a first deflector or traction sheave 36 anchored to a sidewall, ceiling, guide rail or a structure of the hoistway directly above the counterweight, extends horizontally to the drive motor 24, loops 180° about the motor sheave 30, extends about a second deflector or traction sheave 38 anchored to a sidewall or ceiling of the hoistway, extends downwardly toward the elevator car 20, underslings or loops under a floor of the elevator car 20 via elevator sheaves 40, 40 (only one shown in FIGS. 1 and 2) provided underneath and at the sides of the elevator, and extends upwardly and is anchored at a second end to a sidewall or ceiling of the hoistway.

Because the drive motor 24 is provided above the hoistway door 16, the elevator systems 10, 50 avoid the additional expense and space associated with the construction of a conventional machine room for supporting and housing the drive motor 24 and associated control equipment such as a controller and a drive unit.

As best shown in FIG. 1, the drive motor 24 is substantially enclosed by a housing 42 which includes a movable front panel 44 facing and protruding externally of the hoistway 12 into an upper part of an adjacent elevator hallway 46 for easy and safe access by maintenance workers at the topmost landing 18 of the hallway 46. For example, the front panel may include a hinge 48 which permits the front panel 44 to pivot downwardly in the direction shown by the arrow A so that maintenance workers may access the drive motor 24 and any associated equipment from the hallway 46 over the landing 18.

Figure 3:
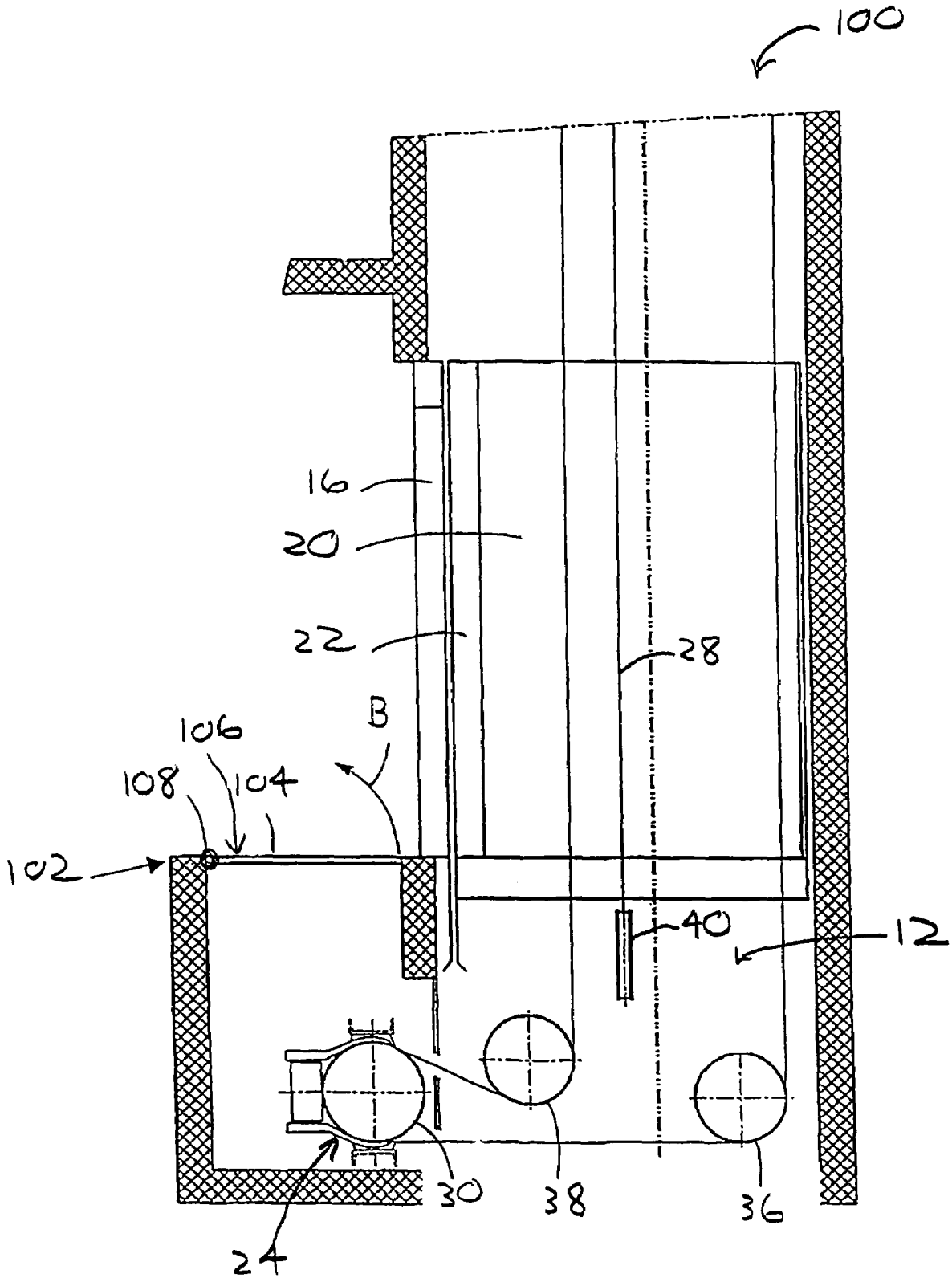
FIG. 3 is a schematic, side elevational view of an elevator system along a portion of a hoistway having the drive motor accessibly located immediately below a hoistway door.

Turning now to FIG. 3, an elevator system illustrating a further embodiment of the present invention is generally designated by the reference number 100. The elevator system 100 is generally similar to the elevator systems 10, 50 of FIGS. 1 and 2 except for the placement of the drive motor 24 and deflector sheaves 36, 38 along the hoistway 12. As shown in FIG. 3, the drive motor 24 may be provided below a hoistway door at the bottommost level or any level along the hoistway except for the topmost level. The deflector sheaves 36, 38 may be located within the hoistway 12 adjacent to and generally at the same level as the drive motor 24. The drive motor 24 is substantially enclosed by a housing 102 which includes a movable front panel 104 forming part of a landing or hallway floor 106 for easy and safe access by maintenance workers. For example, the front panel 104 may include a hinge 108 which permits the front panel to pivot upwardly in the direction shown by the arrow B in order to permit maintenance workers to access the motor 24 and any associated equipment from the hallway landing 106.

Figure 4:
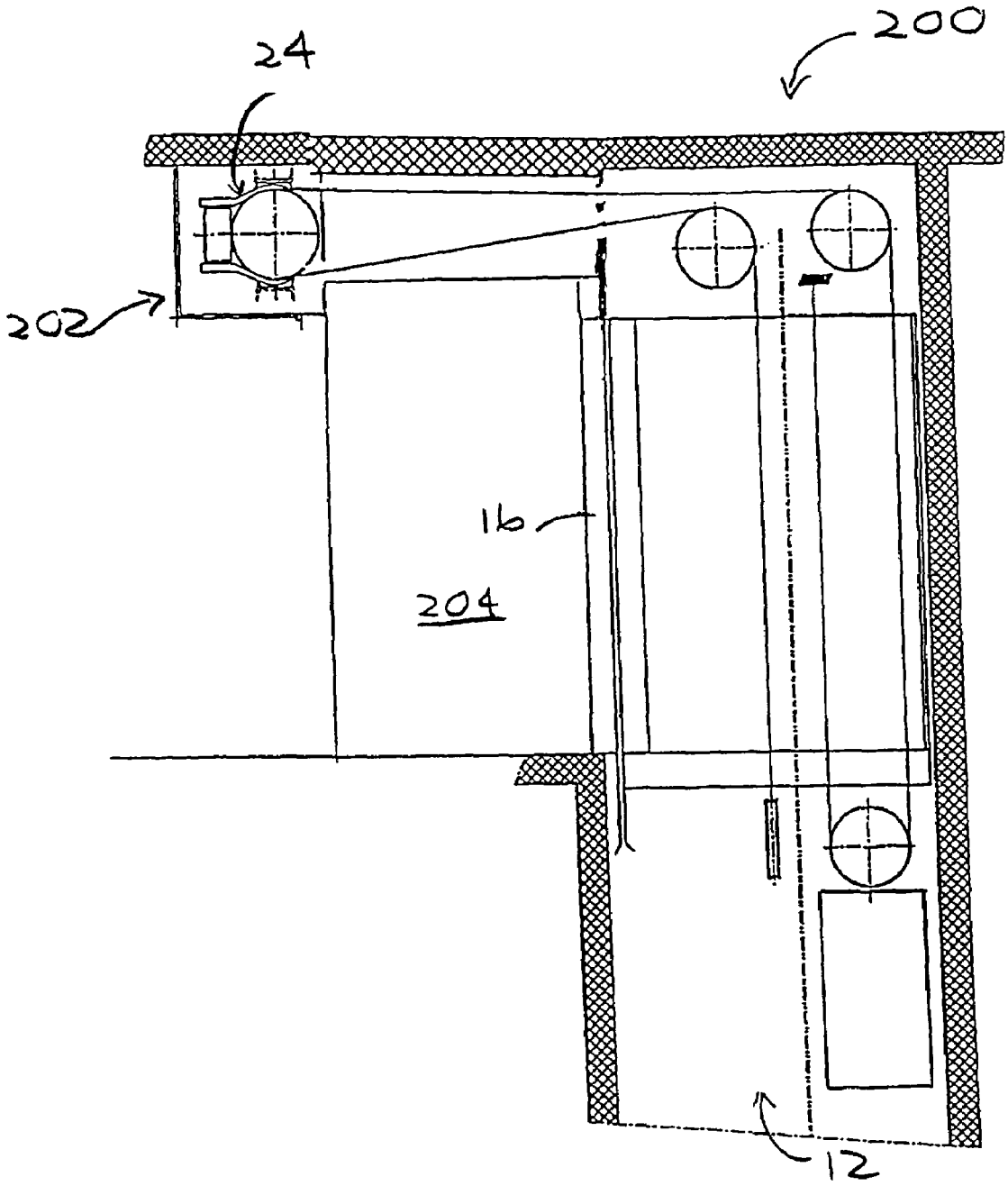
FIG. 4 is a schematic, side elevational view of an elevator system at a top portion of a hoistway having the drive motor accessibly located above and across an elevator hallway from a top portion of a hoistway door.

FIG. 4 illustrates an elevator system 200 illustrating another embodiment of the present invention. The elevator system 200 is generally similar to the elevator systems 10, 50 of FIGS. 1 and 2 except for the placement of the drive motor 24 along the hoistway 12. As in FIGS. 1 and 2, the drive motor 24 may be provided above the hoistway door 16. However, as shown in FIG. 4, the drive motor 24 is substantially enclosed within a housing 202 provided at a remote location at an opposite side of a hallway 204 relative to the hoistway 12 for easy and safe access to the drive motor 24 and any associated equipment from the hallway 204. The drive motor 24 and any associated equipment may also be located at other remote and safe locations which are easily accessible to maintenance workers.

Figure 5:
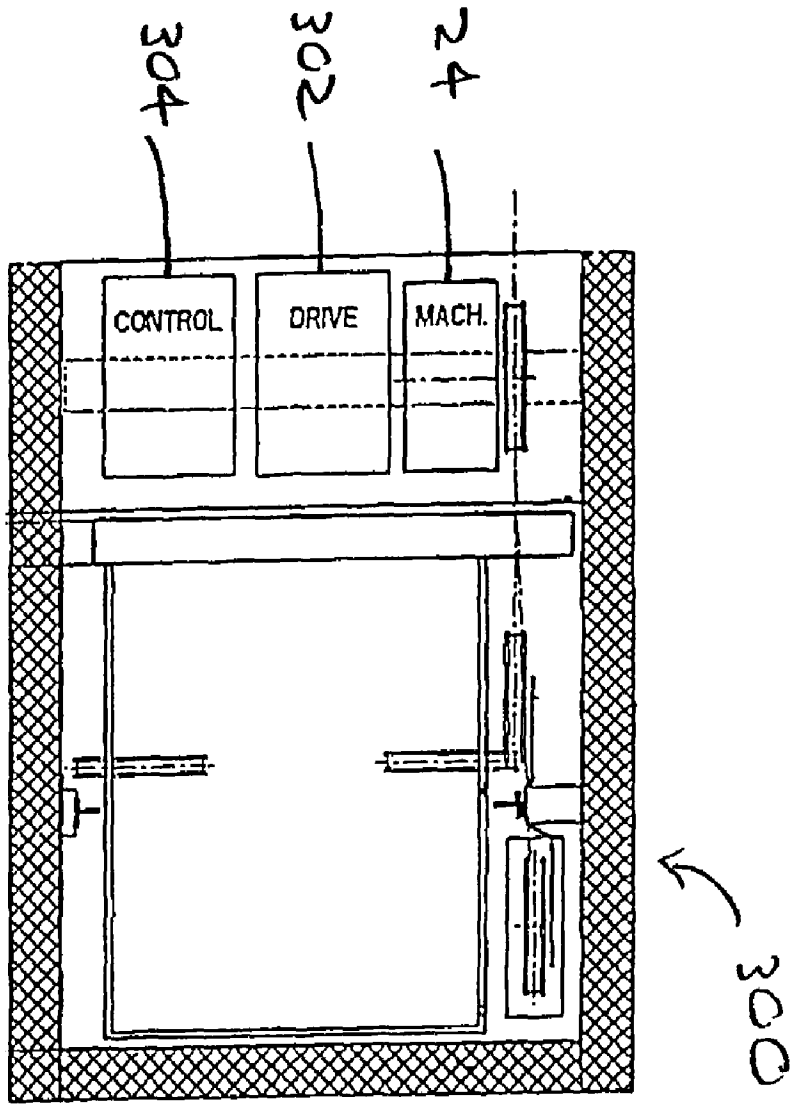
FIG. 5 is a schematic, top plan view of a drive motor/drive unit/control unit which may be provided above or below a hoistway door.

The housings shown in FIGS. 1–4 substantially enclosing the drive motor 24 may also include associated control equipment for easy access from an elevator landing or hallway. As shown in FIG. 5, a housing 300 includes the drive motor 24, a drive unit 302 for supplying high voltage, high current equipment to the elevator car 20, and a drive motor controller 304 for performing operational control and motion control. Operational control includes, for example, storing the location of calls, resetting answered calls, initiating door operation, communicating with a passenger by signaling that a call has been received, providing elevator car position information, and providing a visual indication of an elevator car's direction of travel when the elevator car arrives at a landing. Motion control includes starting and stopping an elevator car by developing the dictation signal that regulates the acceleration, velocity and deceleration of the elevator car, as well as determining whether operation of the elevator car is safe.

Figure 6:
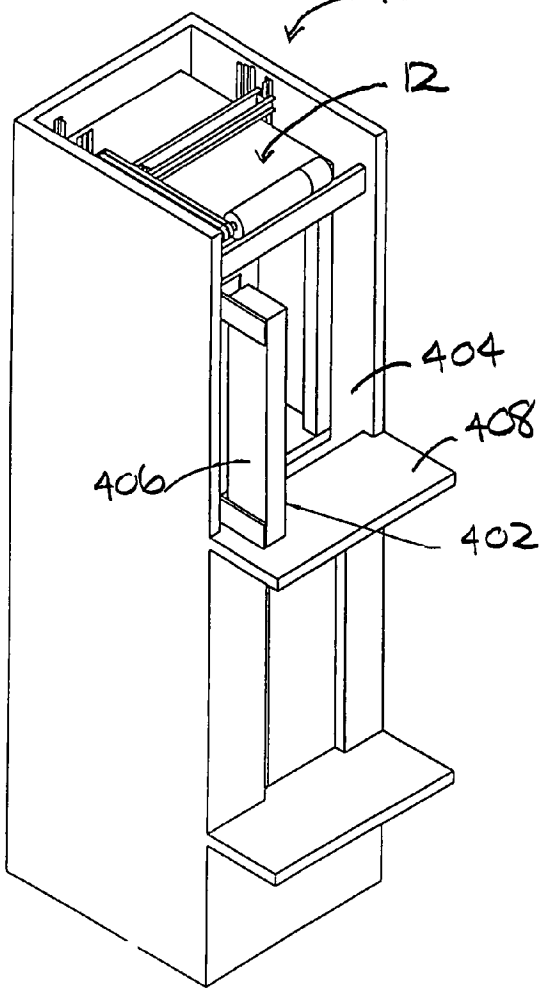
FIG. 6 is a partial, broken away, perspective view of an elevator system showing a slidable control panel for easy access.

FIG. 6 shows an elevator system 400 having alternative means for accessing control equipment. The elevator system 400 is similar to the elevator systems 10, 50 of FIGS. 1 and 2 except that the elevator system 400 includes a slidable control cabinet 402 located at an upper side of the hoistway 12 adjacent to a side of a topmost hoistway door 404. The control cabinet 402 supports a drive motor controller 406, and is slidably movable from a first position within the hoistway to a second position in an adjacent elevator hallway for easy and safe access to the controller by maintenance workers at a hallway landing 408.

Figure 7:
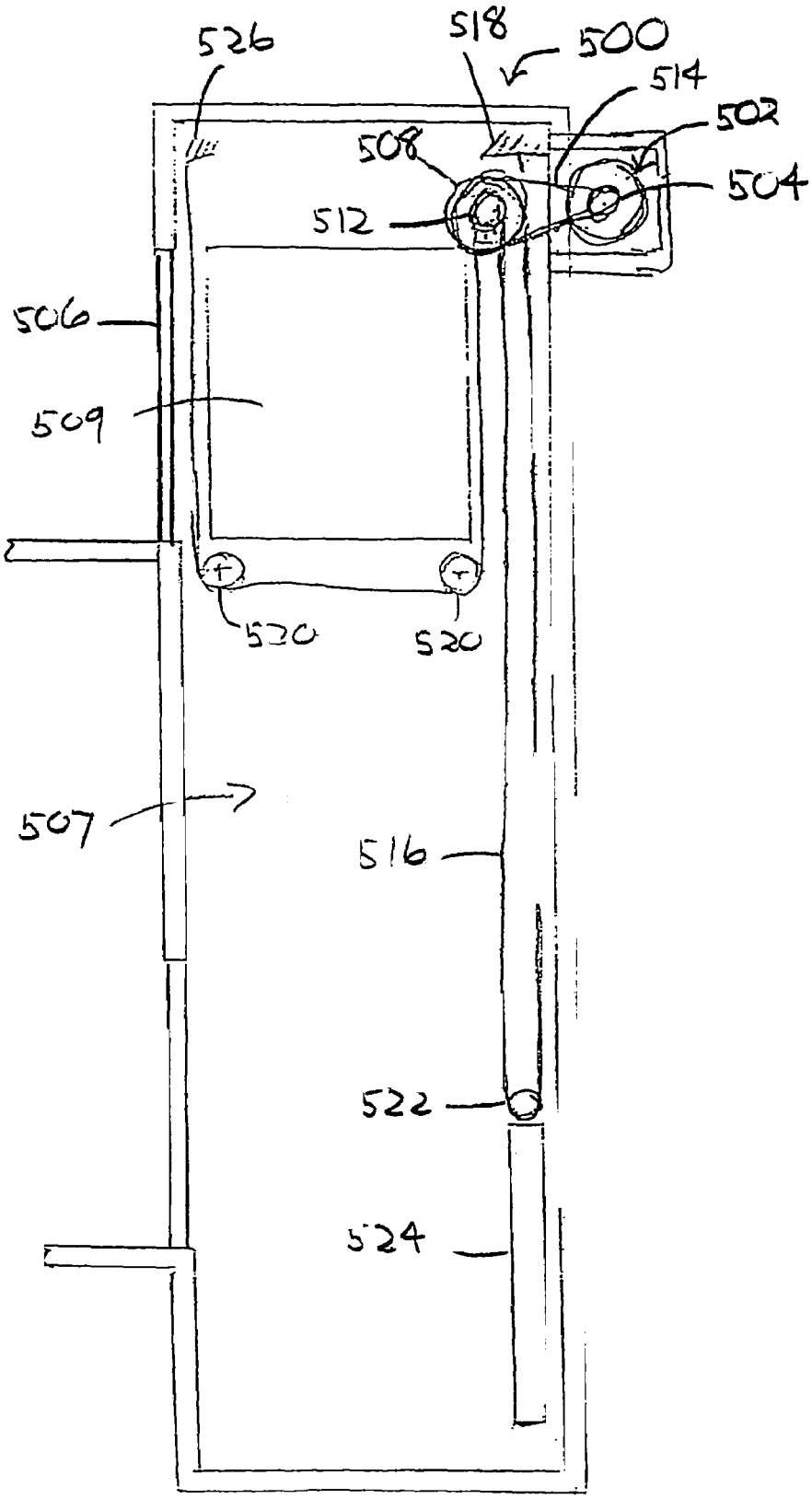
FIG. 7 is a schematic, side elevational view of an elevator system employing flexible flat ropes in accordance with the present invention.

With reference to FIG. 7, an elevator system 500 includes a drive motor 502 and motor sheave 504 located above a topmost hoistway door 506. A first or large diameter deflector sheave 508 is axially coupled to a second deflector sheave 512, and is located above the topmost hoistway door 506 and in a hoistway 507 above an elevator car 509. The diameter of the first deflector sheave 508 is larger than a diameter of the drive sheave 504 and the diameter of the second deflector sheave 512. A closed-loop, first elongated connector 514 or "belt reducer" is coupled to the drive sheave 504 of the drive motor 502 and to the first deflector sheave 508.

A second elongated connector 516 is fixedly coupled to a bracket 518 secured to a sidewall or ceiling of the hoistway 507, extends downwardly and underslings the elevator car 509 via elevator sheaves 520, 520 coupled to an underside of the car, extends upwardly, wraps 1800 about the second or small diameter deflector sheave 512, extends downwardly, wraps 1800 about a counterweight sheave 522 coupled to a top portion of a counterweight 524 and extends upwardly and is coupled to a sidewall or ceiling of the hoistway via a bracket 526.

In operation, the drive motor 502 rotates the drive sheave 504, which in turn rotates the first deflector sheave 508 via the first elongated connector or belt reducer 514 drivingly coupled thereto. Because the first deflector sheave 508 is larger than the diameter of the drive sheave 504, the first deflector sheave 508 rotates at a revolutions per minute (rpm) which is less than that of the drive sheave. The second deflector sheave 512 also rotates at the same rpm as that of the first deflector sheave 508. Therefore, the second deflector sheave 512 which is about the same diameter as that of the drive sheave 504, rotates at a slower rpm relative to that of the drive sheave. The elevator system 500 which employs the belt reducer thereby acts as a type of gearing effect.

An advantage of the elevator system 500 is that the machine room is eliminated. A second advantage is that the drive motor 502 is located above the hoistway door 506 for easy and safe access by maintenance workers. A third advantage is that a relatively inexpensive and small gearless drive motor can replace a more complex geared motor. A fourth advantage is that the location of the deflector sheave 508 in the hoistway 507 over the elevator car 509 permits the roping of the elevator car to be relatively simple. A fifth advantage is that the elevator sheaves 520, 520 are located underneath the elevator car 509 to reduce at a minimum the space required between the car and the hoistway ceiling.

In addition to the above-mentioned advantages, the size of the drive motor and sheaves may be reduced if the elongated connectors are flat ropes or belts. Flat ropes distribute the elevator load over a greater surface area on the sheaves relative to round ropes. The belts may be made from a high traction material such as urethane or rubber. The greater load distribution and high traction results in a smaller drive motor and sheaves required to support and move an elevator load relative to elevator systems employing round ropes.

Figure 8:
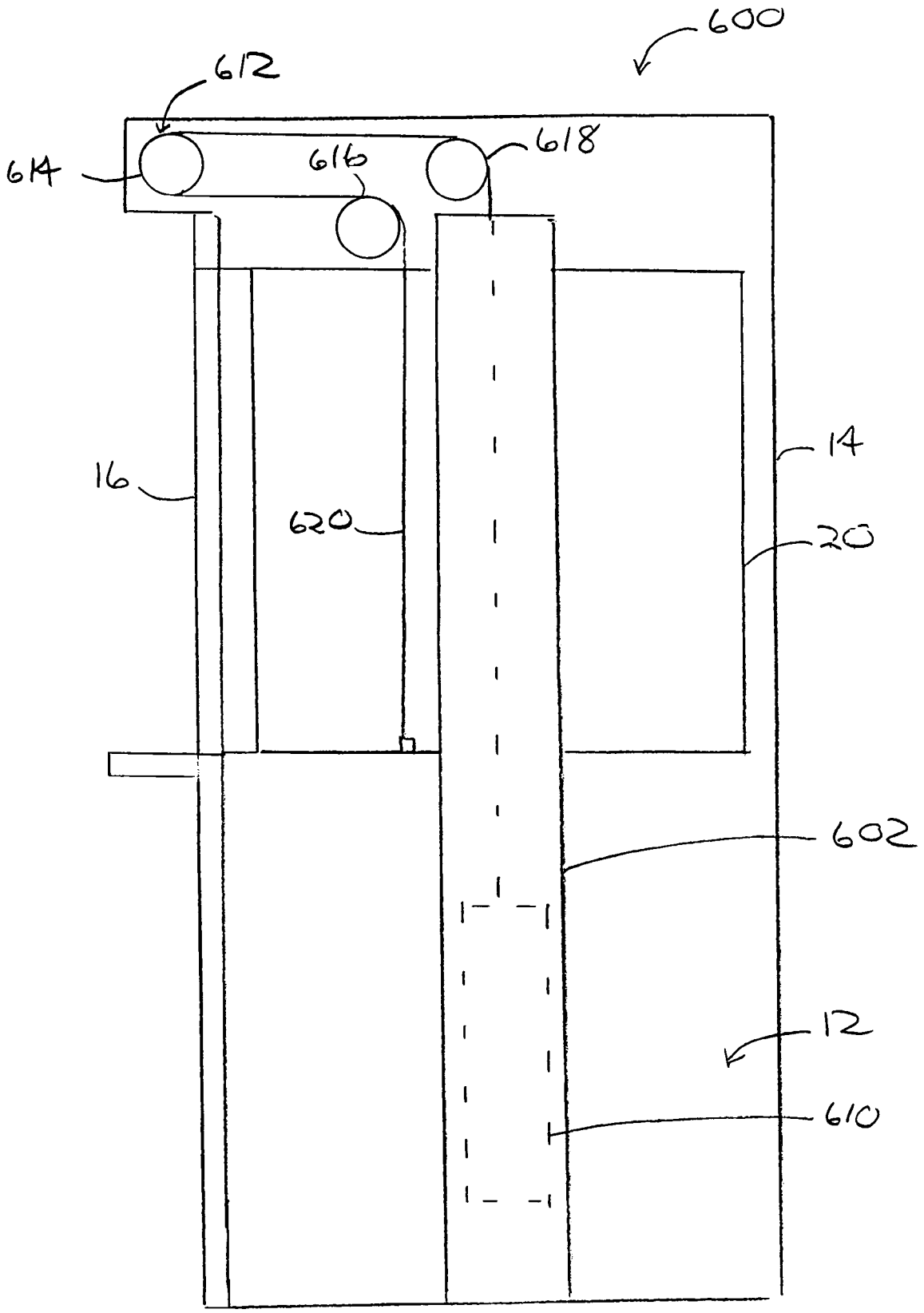
FIG. 8 is a schematic, side elevational view of an elevator system in accordance with a further embodiment of the present invention.
Figure 9:
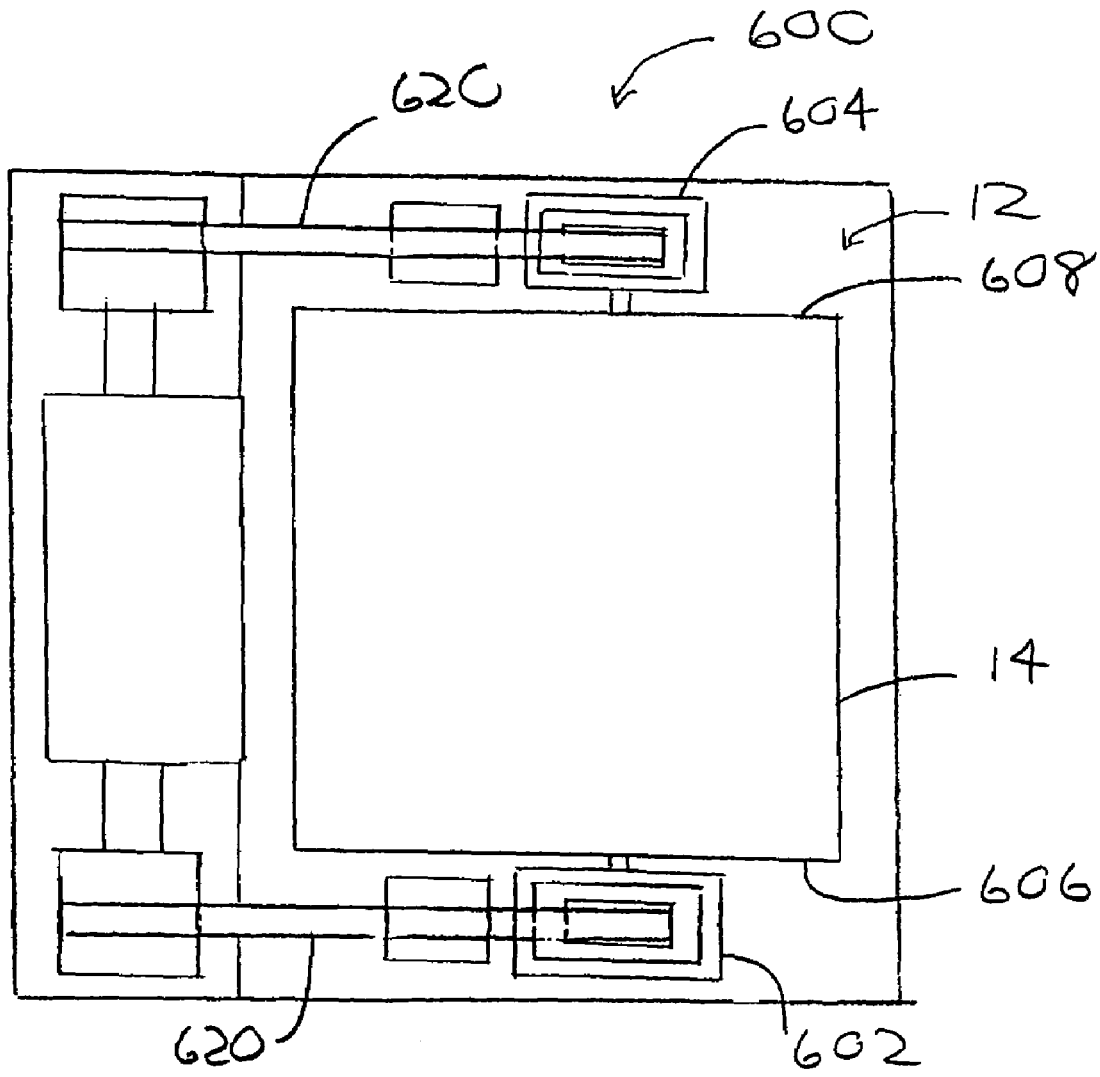
FIG. 9 is a top, plan view of the elevator system of FIG. 8.

FIGS. 8 and 9 illustrate an elevator system 600 in accordance with a further embodiment of the present invention. The elevator system 600 includes a hoistway 12 defined by the surrounding structure 14 of a building. An elevator car 20 is disposed in the hoistway 12 for upward and downward movement therealong. First and second support columns 602 extend along a vertical extent of the hoistway 12 associated with elevator car travel, and are respectively disposed adjacent to oppositely facing sidewalls 606, 608 of the elevator car 20 to support and guide the elevator car 20 for vertical movement therealong. Each of the first and second support columns 602, 604 defines a hollow interior or recess for accommodating an associated counterweight 610 (only one shown) for vertical movement along the associated support column.

A drive motor 612 and associated drive sheaves 614, 614 are disposed adjacent to and above an uppermost hoistway door 16 for moving the elevator car 20 vertically along the hoistway 12. First deflector sheaves 616, 616 and second deflector sheaves 618, 618 are disposed on each side of the elevator car 20 and at a top portion within the hoistway 12 for guiding flat rope or belts 620, 620 between the drive motor 612 and the elevator car 20 and the counterweights 610, 610.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. An elevator system, comprising:

a hoistway having a hoistway door and a ceiling;

an elevator car located in the hoistway;

a drive motor drivingly coupled to the elevator car, the drive motor being located in a fixed position immediately adjacent to one of a top and bottom portion of a hoistway door and below the hoistway ceiling; and a housing for substantially enclosing the drive motor relative to an adjacent hallway, wherein the housing includes a movable panel protruding externally of the hoistway into the adjacent hallway, the movable panel providing access to the drive motor from a position in front of the hoistway door.

2. An elevator system comprising:

a hoistway having a plurality of hoistway doors and a ceiling;

an elevator car and at least one counterweight located in the hoistway;

a drive motor drivingly coupled to the elevator car and counterweight via elongated connectors, the drive motor being locatcd immediately adjacent to one of a top and bottom portion of a hoistway door and below the hoistway ceiling, wherein the drive motor is located above a top portion of a topmost hoistway door; and a housing for substantially enclosing the drive motor relative to an adjacent hallway, wherein the housing includes a movable panel protruding externally of the hoistway into the adjacent hallway, the movable panel providing access to the drive motor from a position in front of the adjacent hoistway door.

3. An elevator system as defined in claim 2, wherein the movable panel is located above a hoistway door.

* * * * *